US009580911B1

(12) United States Patent
O'Mara

(10) Patent No.: US 9,580,911 B1
(45) Date of Patent: Feb. 28, 2017

(54) STAIR TREAD AND IMPROVED METHOD OF BUILDING A STAIRWAY

(71) Applicant: TL FAB, LP, Anaheim, CA (US)

(72) Inventor: Victor O'Mara, Anaheim, CA (US)

(73) Assignee: TL FAB, LP, Anaheim, CA (US)

( * ) Notice: Subject to any disclaimer, the term of this patent is extended or adjusted under 35 U.S.C. 154(b) by 0 days.

(21) Appl. No.: 14/877,042

(22) Filed: Oct. 7, 2015

(51) Int. Cl.

| | |
|---|---|
| ***E04F 11/00*** | (2006.01) |
| ***E04F 11/035*** | (2006.01) |
| ***E04F 11/025*** | (2006.01) |
| ***E04F 11/104*** | (2006.01) |
| ***E04F 11/116*** | (2006.01) |
| ***E04F 11/17*** | (2006.01) |

(52) U.S. Cl.
CPC ..... *E04F 11/035* (2013.01); *E04F 11/025* (2013.01); *E04F 11/1045* (2013.01); *E04F 11/116* (2013.01); *E04F 11/17* (2013.01)

(58) Field of Classification Search
CPC ... E04F 11/035; E04F 11/1045; E04F 11/025; E04F 11/116; E04F 11/17
USPC ..... 52/184, 187, 188, 189, 309.4, 309.7, 52/309.12
See application file for complete search history.

(56) References Cited

U.S. PATENT DOCUMENTS 485,449 A * 11/1892 Borneman et al. ... E04F 11/032 52/187
1,063,216 A * 6/1913 Rendle et al. ..... E04F 11/025 52/188
1,078,403 A * 11/1913 Anderson ..... E04F 11/025 52/188
1,385,209 A * 7/1921 Hall ..... E04F 11/025 52/191
1,436,281 A * 11/1922 Mitchell ..... E04F 11/112 52/188
1,533,166 A 6/1923 Daly
1,474,850 A * 11/1923 Rudloff ..... E04F 11/025 52/191
1,536,895 A * 5/1925 Lindyberg ..... E04F 11/163 52/177
1,862,958 A * 6/1932 Hall ..... E04F 11/025 52/191
2,221,358 A 10/1938 Neal
2,205,859 A * 6/1940 O'Donnell ..... E04F 11/025 52/188
2,555,002 A * 5/1951 Phillips ..... E04F 11/025 52/188
3,055,146 A 9/1962 Lobato
3,216,160 A * 11/1965 Best ..... E04F 11/028 52/189
3,370,387 A * 2/1968 Sivley ..... E04F 11/022 52/127.3
3,381,775 A * 5/1968 Livers ..... E04F 11/025 182/106
3,466,820 A 9/1969 Sender
(Continued)

*Primary Examiner* — Basil Katcheves
(74) *Attorney, Agent, or Firm* — Russo & Duckworth, LLP; David G. Duckworth

(57) ABSTRACT

A stair tread and method of building a stairway is provided. Each stair tread includes a metal pan having one or more walls forming a cavity. Concrete filler is disposed in the cavity to provide an upper walking surface. Reinforcement bars and foam blocks can be positioned within the cavity. Concrete treads including the pan can then be transported to a job site for attachment between a pair of stringers.

4 Claims, 10 Drawing Sheets

(56) References Cited

U.S. PATENT DOCUMENTS 3,467,220 A * 9/1969 Harley ..... E04F 11/028 182/115
3,667,572 A * 6/1972 Anderson ..... E06C 7/083 182/220
3,670,848 A * 6/1972 Raiguel, Jr. ..... E04F 11/02 182/115
3,747,709 A * 7/1973 Ridenour ..... E04F 11/025 182/219
3,834,098 A * 9/1974 Wutzke ..... B28B 23/0056 182/228.1
3,839,840 A * 10/1974 Miller ..... E04F 11/025 52/188
3,986,579 A * 10/1976 Howard ..... E04F 11/0255 182/189
4,161,232 A * 7/1979 Bustin ..... B60R 3/00 182/222
4,631,880 A * 12/1986 Leicht ..... E04F 11/0255 182/228.3
4,757,653 A * 7/1988 Anderholm ..... E04F 11/00 403/199
4,791,764 A * 12/1988 Hicks ..... E04F 11/108 52/187
4,819,391 A * 4/1989 Tassin ..... E04F 11/1041 52/182
4,838,005 A * 6/1989 Graham ..... E04F 11/112 52/188
4,866,894 A * 9/1989 Brown ..... E04B 1/2612 52/182
4,899,504 A * 2/1990 Hirschhorn ..... E04F 11/112 182/93
4,995,205 A 2/1991 Bennett
D322,134 S * 12/1991 Eickhoff ..... D25/68
D341,431 S * 11/1993 Kniefel ..... D25/69
5,511,347 A * 4/1996 Schwarz ..... B28B 7/225 52/182
6,029,408 A * 2/2000 Cavaness ..... E04F 11/025 52/182
6,665,987 B2 * 12/2003 Eve ..... E04F 11/112 156/64
7,047,698 B2 5/2006 Torch
7,845,123 B2 12/2010 Tada
8,307,603 B1 * 11/2012 Mitchell ..... 52/188
8,935,894 B1 * 1/2015 Classen ..... E04F 11/09 52/189
D733,932 S * 7/2015 Classen ..... D25/69
2002/0124492 A1 * 9/2002 Gobeil ..... E04F 11/00 52/191
2009/0293385 A1 * 12/2009 Vargas ..... E04F 11/025 52/191

* cited by examiner

STAIR TREAD AND IMPROVED METHOD OF BUILDING A STAIRWAY

BACKGROUND

Field of the Invention

The present disclosure is generally directed to pre-fabricated stair treads and to methods for manufacturing pre-fabricated stair treads. Moreover, the present disclosure relates to novel methods of manufacturing a stairway from pre-fabricated stair treads.

Description of the Related Art

Presently, traditional concrete stairway treads are constructed in one of two ways. A first manufacturing technique entails forming a mold onsite and pouring the concrete in place. This process creates a stairway that includes a heavy fat slab and requires unnecessarily large amounts of concrete. Typically the stairway treads are formed very roughly, and mortar can be applied to provide a finished surface.

The second method for constructing a stairway includes forming the concrete treads offsite. This process typically includes utilizing pans which form a mold. Concrete is poured into the mold and allowed to harden. The hardened concrete step is removed from the mold and then transported to the construction site for affixing the stair tread to a stairway stringer.

SUMMARY

Prior manufacturing methods suffer from several drawbacks. If manufactured onsite, the process often require the difficult and expensive step of pouring the concrete in place. When pre-molded offsite, prior manufacturing methods tend to be expensive and pose the risk of damage or breakage during transportation. A need therefore exists for an improved stair tread that can be produced cost efficiently, can be less susceptible to breakage during transportation, and can offer greater aesthetics as compared to previous stair treads.

The systems, apparatuses, and methods described herein addresses the aforementioned disadvantages by providing an improved stair tread and an improved method for building a stairway. Without limiting the scope of this disclosure, its more prominent features will be discussed briefly. After considering this discussion, and particularly after reading the Detailed Description of Certain Embodiments section below in combination with this section, one will understand how the features and aspects of these embodiments provide several advantages over prior stair treads and methods of manufacture.

To improve upon current manufacturing methods, it would be desirable to provide a stairway that could be manufactured without the expense of fabricating a unique mold onsite for each installation. Moreover, it would be desirable to provide a method of manufacturing a stair tread and stairway which enabled one to manufacture the stair treads offsite. It would also be desirable to provide a prefabricated stair tread that was sturdier and less prone to breakage during transportation from the manufacturing site to the construction site. In still an additional advantage would be to provide a stair tread that offered improved aesthetics compared to previous stair treads.

In certain embodiments, the stair tread is prepared "offsite". The term "offsite" is meant to be interpreted to mean that the stairway tread is not formed onsite within the stairwell. Instead, the stair tread is engineered or otherwise formed at a location outside of the stairway, and then transported to the stairway for installation.

In certain embodiments, the stair tread includes a base pan. The base pan is sized and shaped to form the stair tread. In certain embodiments, the base pan can have a generally rectangular, square, circular, half-circular, or other desired shape. In certain implementations, the base plan is made of metal. For example, the base pan can be made of 20 gauge steel. The base pan includes one or more walls to form the desired shape of the stair tread. In certain embodiments, the base plan includes a bottom wall which can be planar and substantially horizontal. In addition, for a rectangular shaped stair tread, the base pan can include a front wall, a rear wall, and opposing first and second sidewalls. The front wall forms the front of the tread or step, which is easily seen by those walking up a stairway. The rear wall forms the rear of the tread or step which is typically not easily seen by those walking upon the stairway. Meanwhile, the opposing first and second sidewalls of the base pan form the sides of the tread or step. In certain embodiments, the first and second sidewalls affix to stairway stringers.

The base pan includes at least one cavity. In certain embodiments, at least one cavity is formed by the front wall, the rear wall and the sidewalls extending upward from the bottom wall. Of course, additional cavities can be formed in the base pan. For example, one or more internal webs can form a plurality of cavities. The base pan may be formed by various construction methods known to those skilled in the art including the stamping of sheet metal or the welding of planar components together to form a unitary pan.

In certain embodiments, the stair tread includes a concrete component. The concrete component can be formed by pouring pre-hardened concrete into the base pan's cavity so as to substantially fill the base pan's cavity. The concrete is allowed to harden to form an upper walking surface. Decorative features such as tile or stone may be affixed to the upper walking surface. In certain embodiments, non-slip materials may be integrated into the concrete upper walking surface.

In certain embodiments, the stair tread includes metal reinforcements and/or foam inserts. For these embodiments, prior to pouring the pre-hardened concrete into the base pan's cavity, steel reinforcements such as laterally extending rebar or the like are positioned in the base pan to reinforce the stair tread. Moreover, one or more foam blocks may be placed within the base pan's cavity prior to the pre-hardened concrete being formed into the base pan. The foam blocks may be selected by those skilled in the art and virtually any type of foam can be utilized so as to reduce the weight of the completed stair tread.

Once the concrete has been poured and allowed to harden, the stair tread is complete and ready to be installed. The hardened stair tread includes the metal pan and concrete filler. In certain embodiments, the hardened stair tread further includes any metal or foam inserts. The completed stair tread is then transported to the installation site where the stair tread is affixed to the stairway stringers. As explained above, transportation of the completed stair tread from offsite to onsite can include moving the stair tread from a location outside of the stairway to a location inside the stairway. The stair tread is affixed to the stairway stringers by various fasteners known to those skilled in the art. However, in certain embodiments, the stair tread is provided with brackets which are welded to the base pan sidewalls. The brackets are positioned and configured for affixing to corresponding brackets affixed to the stairway stringers. In certain embodiments, each bracket includes one or more downwardly projecting flanges which are sized and oriented to drop into slots formed in the stringer brackets. In certain embodiments, the base pan of the stair tread can be affixed to the stringer utilizing more conventional fasteners such as nuts and bolts, or welding the brackets to stringer brackets. A large number of stair treads can be affixed to the stringers to form a traditional stairway which complies with all local, state and federal ordinances.

Various modifications of the stair tread can be made. For example, the front side of the stair tread's base pan is particularly suited for aesthetic improvements. For example, the base pan can be painted or powder coated to provide a front side having improved aesthetics compared to traditional concrete treads. Furthermore, the base pan's front side can be shaped or stepped to provide a more aesthetically pleasing appearance.

Thus it is an object of the present disclosure to provide an improved stair tread that can be manufactured offsite through mass production manufacturing and then installed onsite at a construction site.

Moreover, it is an object of the present disclosure to provide stair treads having increased uniformity and improved aesthetics.

It is an additional object of the present disclosure to provide a stair tread which has improved stiffness and yet lighter weight than traditional stair treads.

It is still an additional object of the present disclosure to provide a stairway having improved aesthetics at a reduced cost.

Other features and advantages of the present disclosure will be appreciated by those skilled in the art upon reading the detailed description which follows with reference to the attached drawings.

BRIEF DESCRIPTION OF THE DRAWINGS

These and other features, aspects, and advantages of the stair treads disclosed herein are described below with reference to the drawings of preferred embodiments, which are intended to illustrate and not to limit the invention. Additionally, from figure to figure, the same reference numerals have been used to designate the same components of an illustrated embodiment. The following is a brief description of each of the drawings.

DETAILED DESCRIPTION OF CERTAIN EMBODIMENTS

The systems, apparatuses, and methods described herein addresses the aforementioned disadvantages by providing an improved stair tread and an improved method for building a stairway. While several particular embodiments are illustrated and described, it will be apparent that various modifications can be made without departing from the spirit and scope of the present disclosure. In addition, while a number of variations of the present disclosure have been shown and described in detail, other modifications, which are within the scope of this disclosure.

Figure 6A:
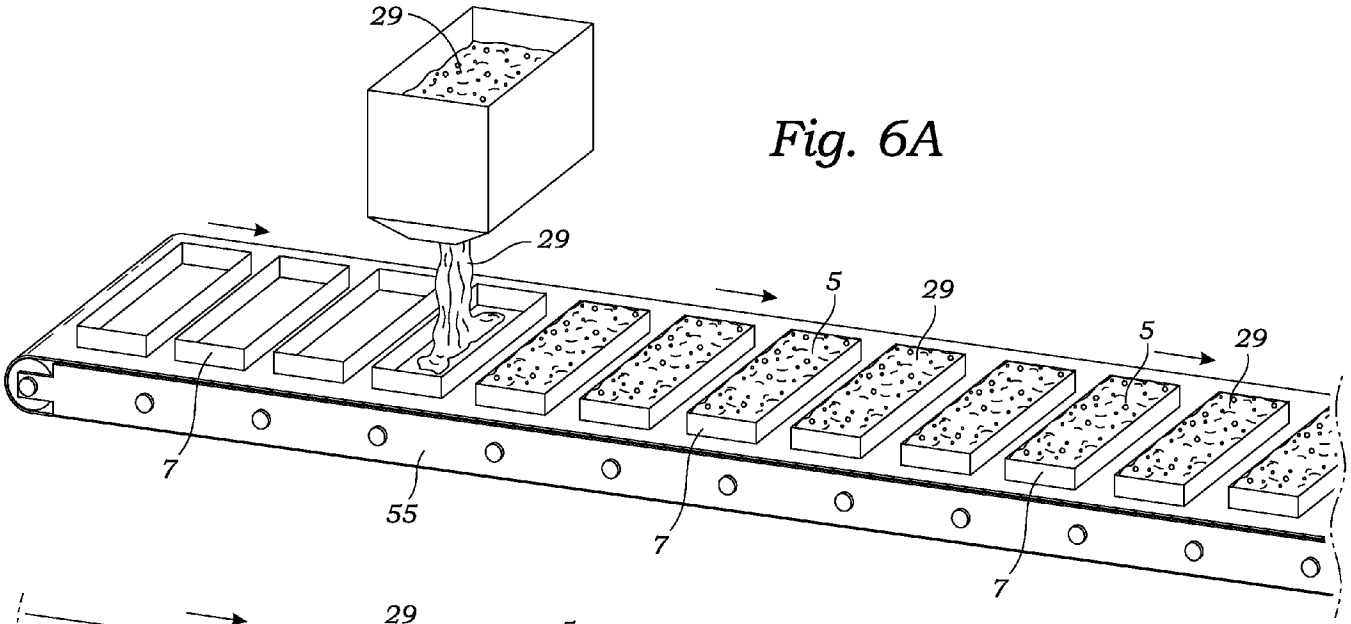
FIG. 6A is a perspective view illustrating the use of a conveyor belt to assist in the manufacturing of a plurality of stair treads similar to the stair tread illustrated in FIG. 4 except the plurality of stair treads do not include metal reinforcements or foam inserts.
Figure 6B:
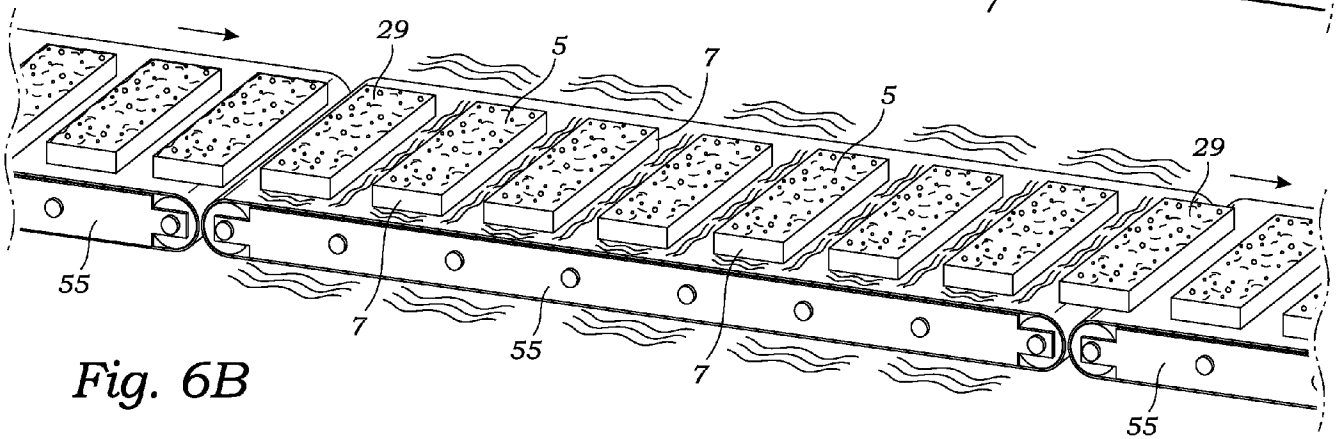
FIG. 6B is a perspective view similar to FIG. 6A except a plurality of conveyor belts are arranged end to end.
Figure 6C:
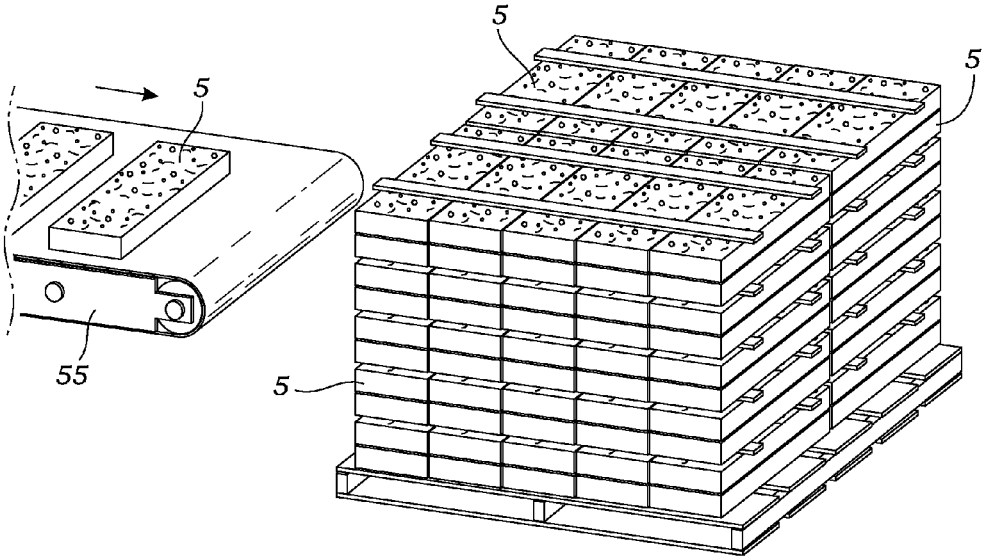
FIG. 6C is a perspective view illustrating the plurality of stair treads stacked upon a pallet for shipment to an installation site.
Figure 7:
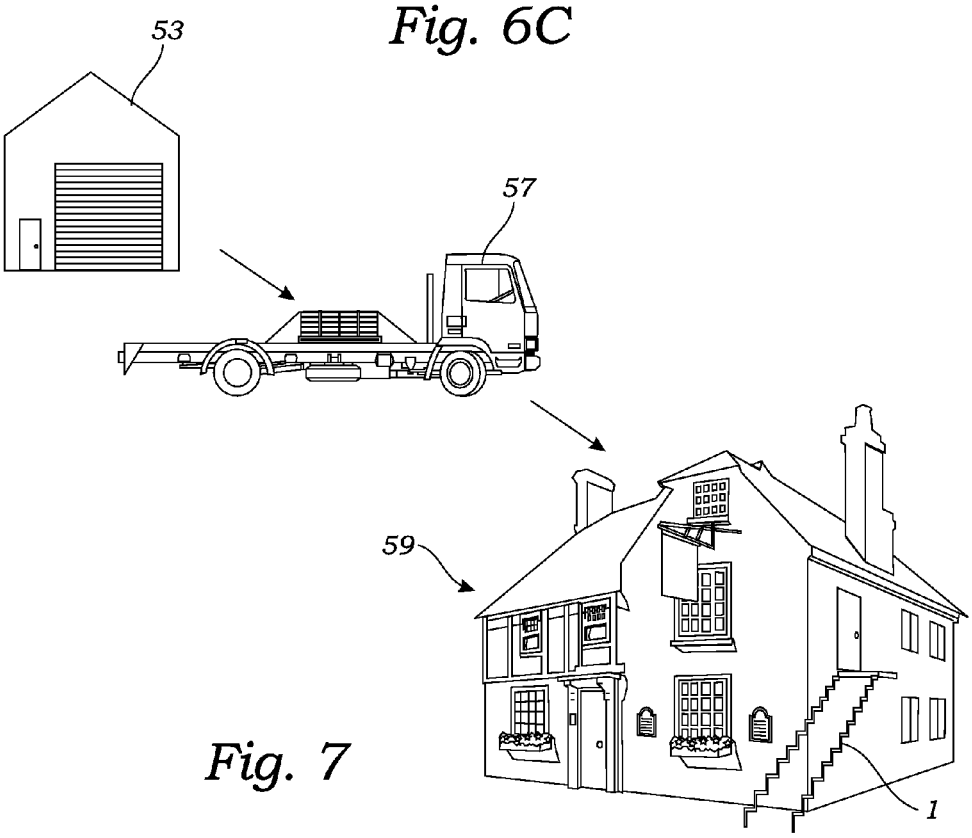
FIG. 7 is a pictorial flow chart illustrating the transportation of prefabricated treads from a manufacturing site to an installation site.
Figure 9:
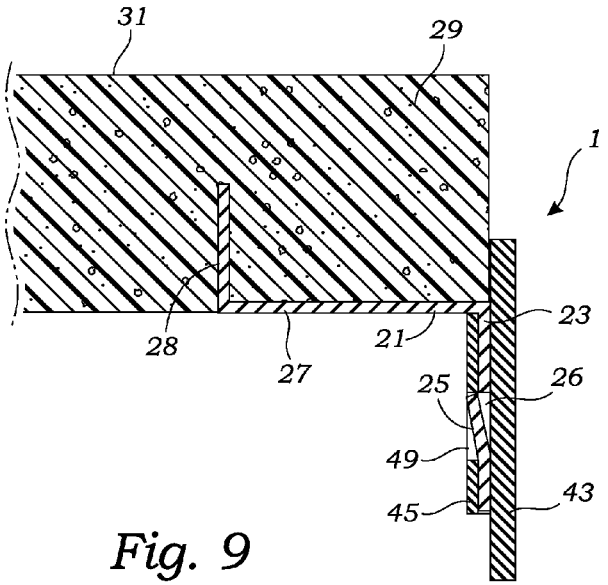
FIG. 9 is a side cutaway view through FIG. 8C showing the stair tread attached to the stringer forming a portion of a stairway.
Figure 10:
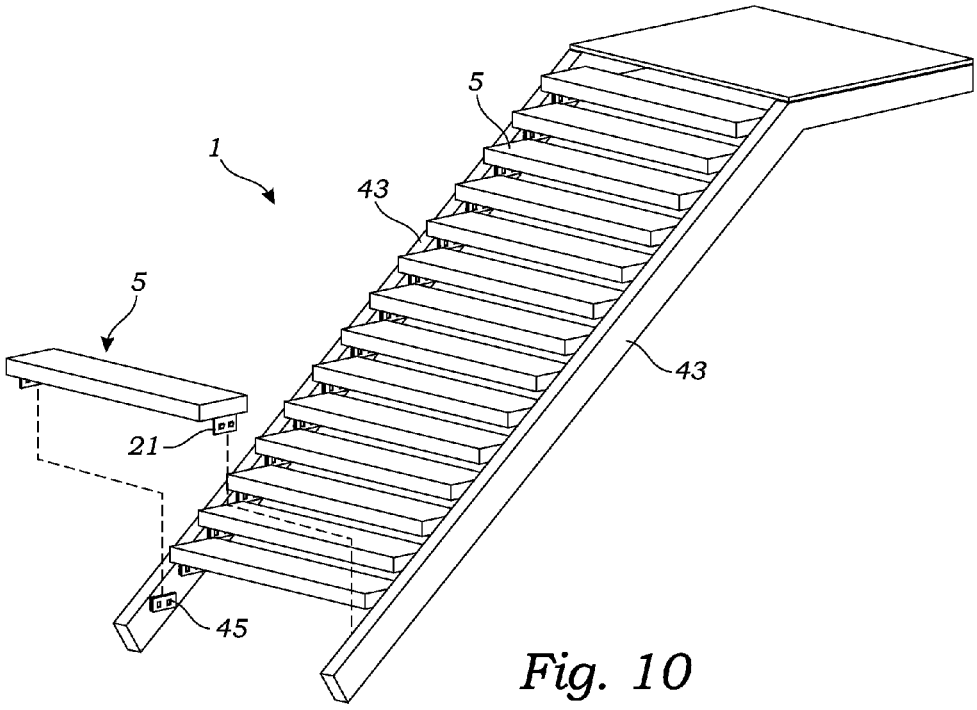
FIG. 10 is a perspective view illustrating a plurality of stair treads forming the stairway.
Figure 11:
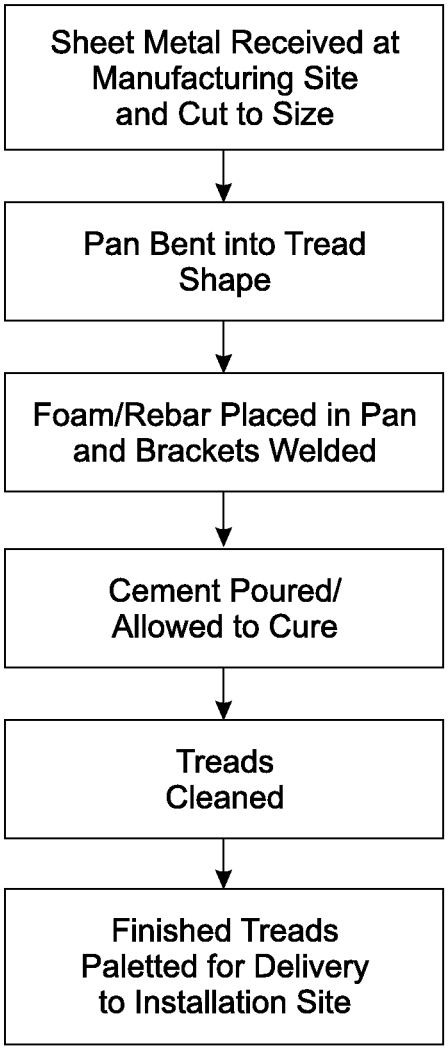
FIG. 11 is a flow chart illustrating the manufacturing steps to prepare the stair tread illustrated in FIG. 4.

With reference to FIGS. 1-11, the present disclosure provides an improved stair tread 5 and method of constructing a stairway assembly 1. As illustrated in FIGS. 6-7 and 11, in certain embodiments the stair tread 5 is manufactured at a manufacturing site 53 which is located some distance away from the installation site 59, also referred to as the job site. Of course, the stair tread 5 need not be manufactured some distance away and instead can be manufactured at the job site. In certain embodiments, the stair tread 5 is prepared at the job site but outside of the stairway 1. In such an embodiment, the stair tread 5 is still considered to be made "offsite". The term "offsite" is meant to be interpreted to mean a location that is not within the stairway or stairwell itself. Thus, in certain embodiments, the stair tread 5 is engineered or otherwise formed at a location outside of the stairway or offsite, and then transported to the stairway 1 for installation.

The stair tread 5 includes a pan 7. The pan 7 is sized and shaped to form the stair tread 5. In certain embodiments, the pan 7 can have a generally rectangular, square, circular, half-circular, or other desired shape. The pan 7 includes one or more walls or webs to form the desired shape of the stair tread 5. In certain embodiments, the pan 7 includes a bottom wall 9, a front wall 11, a rear wall 17, and opposing first and second sidewalls 13 and 15. Each of the respective walls, including the bottom wall 9, may be constructed to have various shapes. For example, the bottom wall 9 may be corrugated or include laterally extending or longitudinally extending ridges to provide flexibility or stiffness. However, in certain embodiments, the tread 5 includes a bottom wall 9 that is a simple construction having a planar rectangular shape which extends substantially horizontally. In certain embodiments, the remaining front wall 11, rear wall 17 and opposing first and second sidewalls 13 and 15 will extend at least partially vertically so as to form at least one cavity 19. Since the rear wall 17 is not anticipated to be easily seen, in certain embodiments the rear wall 17 extends substantially vertically. In certain embodiments, the first and second sidewalls 13, 15 also extend substantially vertically for facilitating their attachment to stairway stringers 43. Meanwhile, as illustrated in FIGS. 5B-5E, in certain embodiments, the front wall 11 includes a stepped or slanted shape so as to provide improved aesthetics. Moreover, the slanted or stepped construction is considered advantageous for receipt of a person's toes so as to extend the useful walking surface of an underlying stair tread 5. The pan 7 may be made of various materials including metal. In certain embodiments, the pan 7 is made from steel, steel alloys, or aluminum.

With reference particularly to FIGS. 3-6, the stair tread 5 also includes concrete 29. While the concrete 29 is still wet, meaning pre-hardened, the concrete 29 is poured into at least one cavity 19 so as to substantially fill the cavity 19. The cavity 19 may be entirely filled so as to form a walking surface 31. In certain embodiments, the cavity 19 is filled to a height which is level with the height of the pan's front wall 11, rear wall 17, and sidewalls 13, 15. In certain embodiments, the concrete 29 is poured to just below the level of the front wall 11, rear wall 17, and sidewalls 13, 15 so as to allow the placement of decorative stone or tile upon the concrete 29 so as to provide a top walking surface 31 at the same level or a level slightly above the top of the pan 7. In certain embodiments, the pan 7 includes one or more webs disposed between opposite walls 11, 17, 13, 15 of the pan 7 and forming a plurality of cavities 19 in the pan 7.

Figure 1:
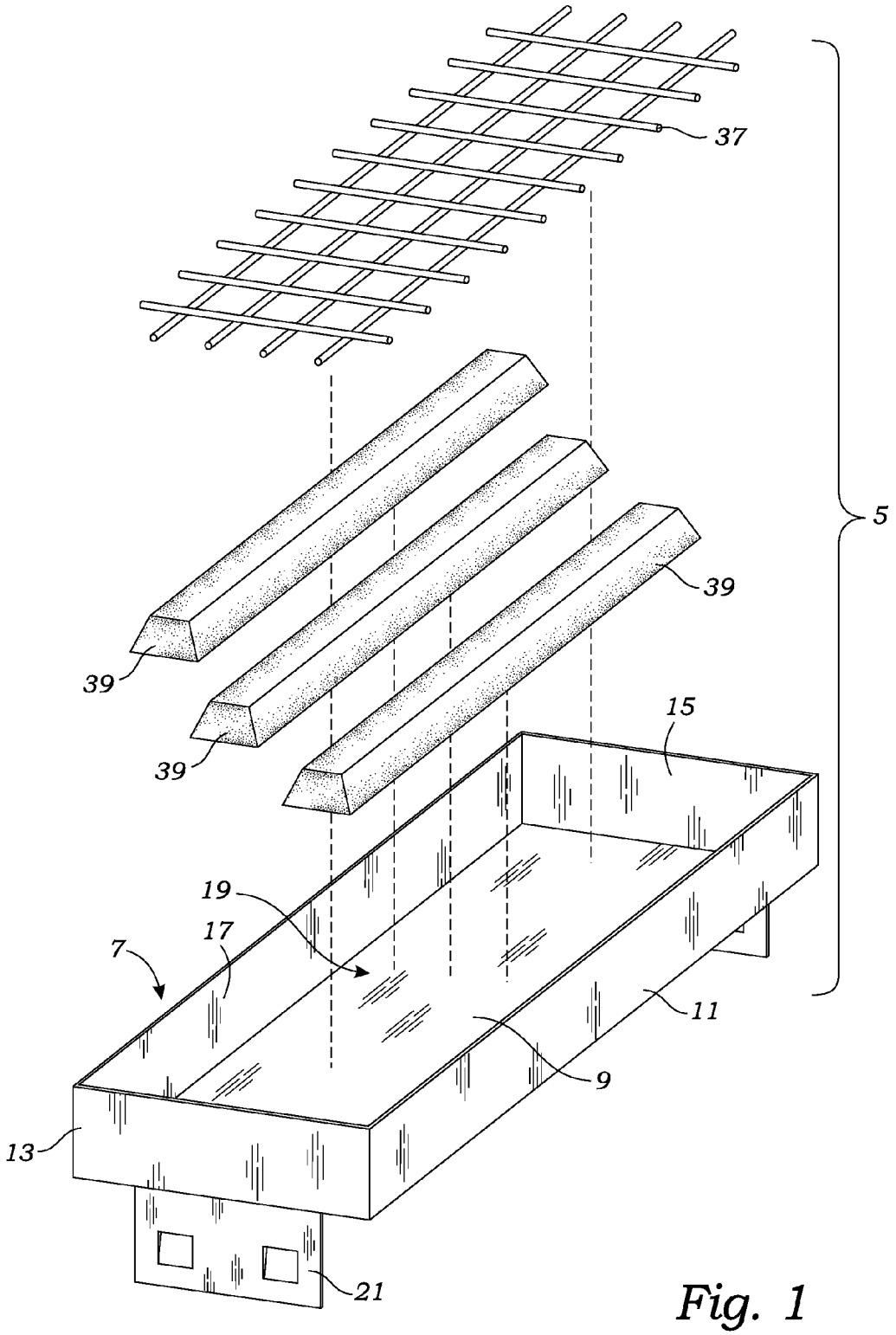
FIG. 1 is an exploded perspective view of an embodiment of a stair tread without concrete and that optionally includes metal reinforcements and foam inserts.
Figure 2:
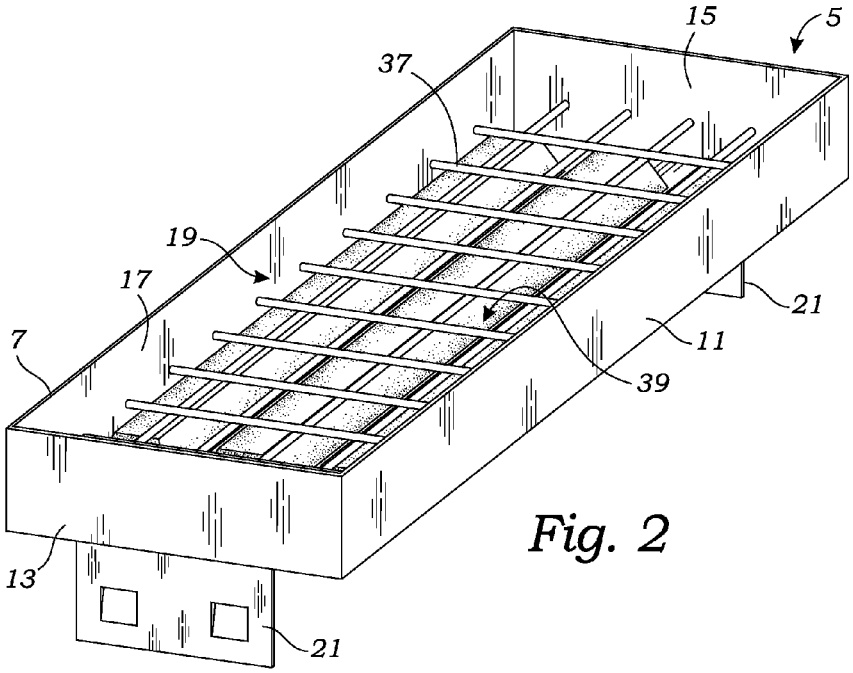
FIG. 2 is a perspective view of the stair tread from FIG. 1 assembled and prior to a pouring of concrete.
Figure 3:
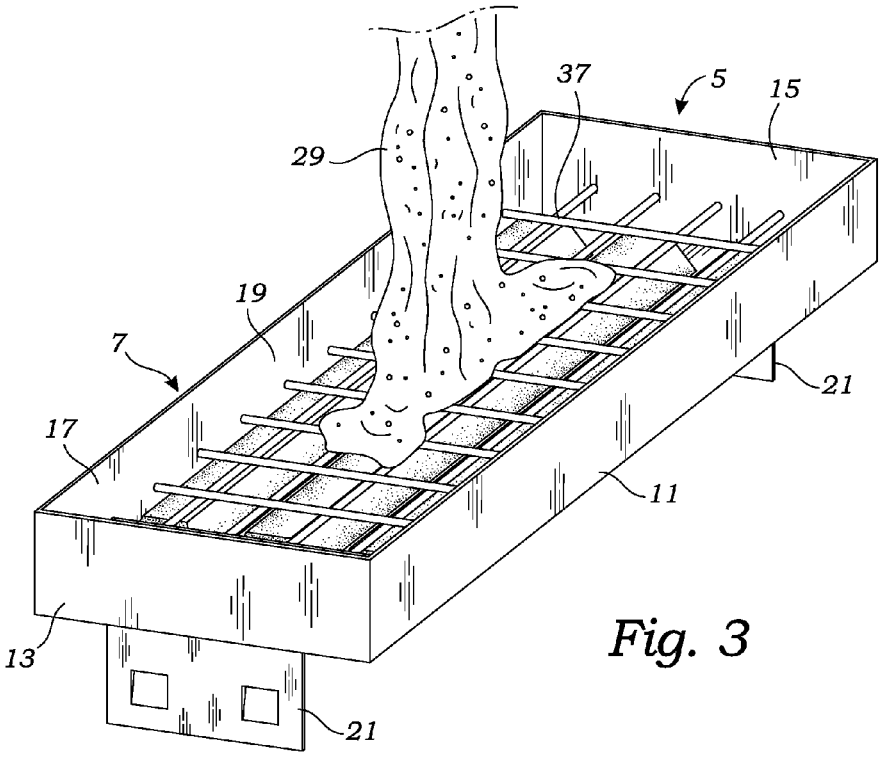
FIG. 3 is a perspective view of the stair tread from FIG. 2 as concrete is being poured.
Figure 4:
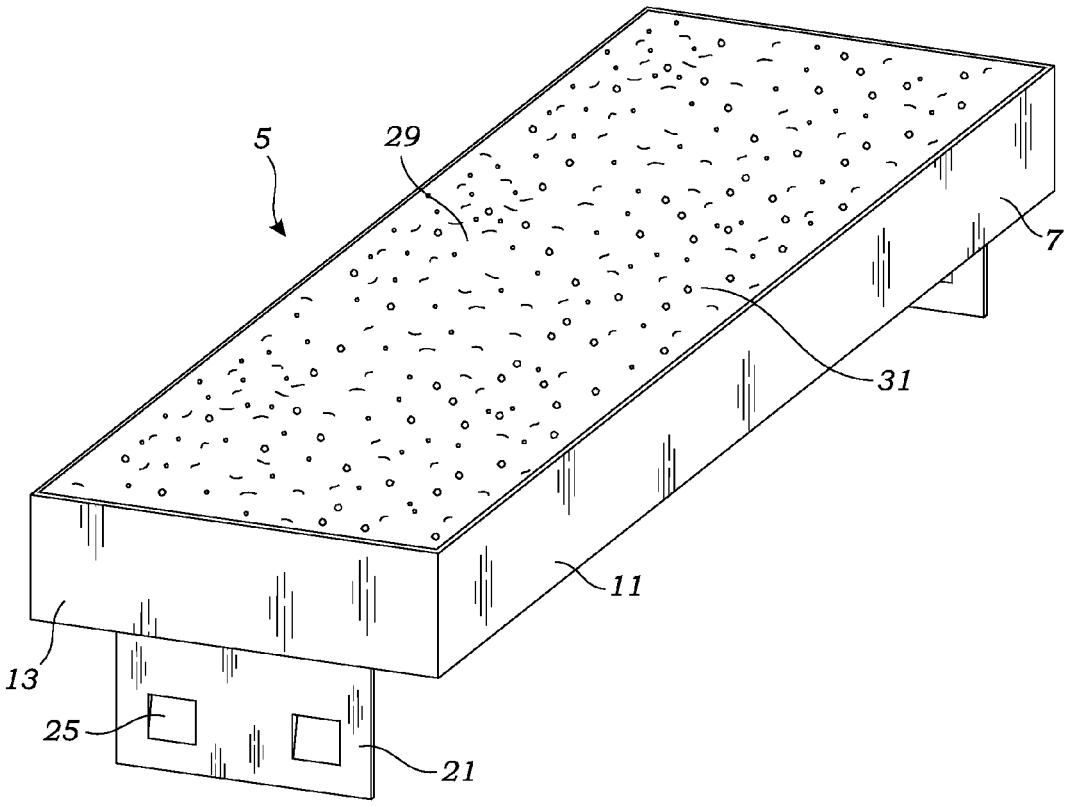
FIG. 4 is a perspective view of the stair tread from FIG. 3 filled with concrete.
Figure 5A:
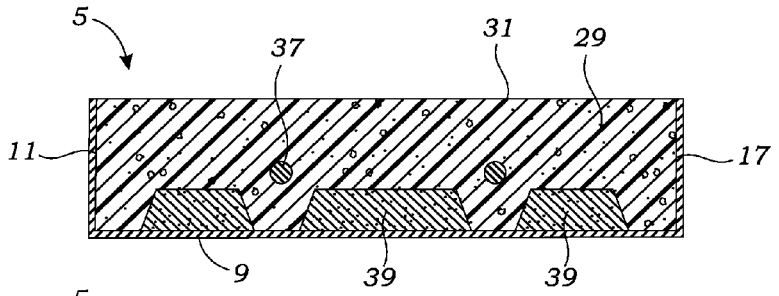
FIG. 5A is a side cross-sectional view of a first embodiment of the stair tread from FIG. 4.
Figure 5B:
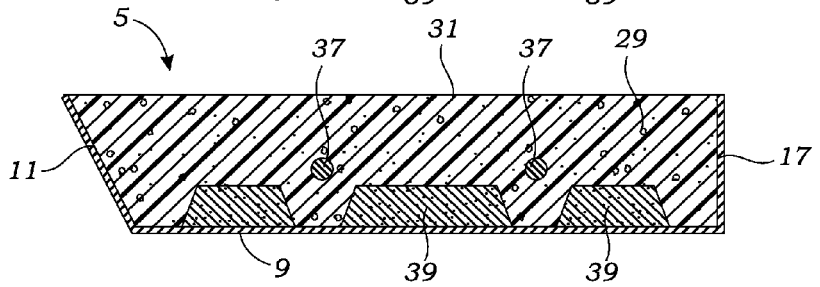
FIG. 5B is a side cross-sectional view of a second embodiment of the stair tread from FIG. 4.
Figure 5C:
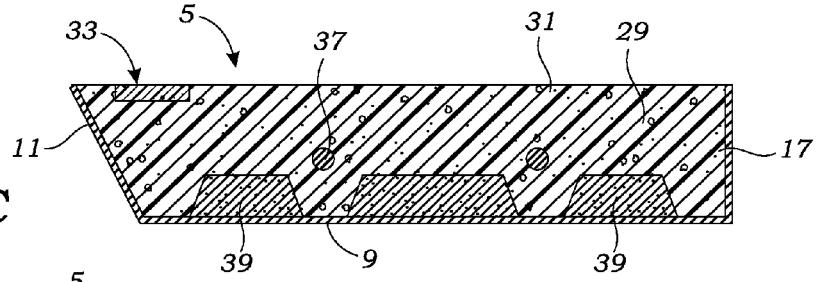
FIG. 5C is a side cross-sectional view of a third embodiment of the stair tread from FIG. 4.
Figure 5D:
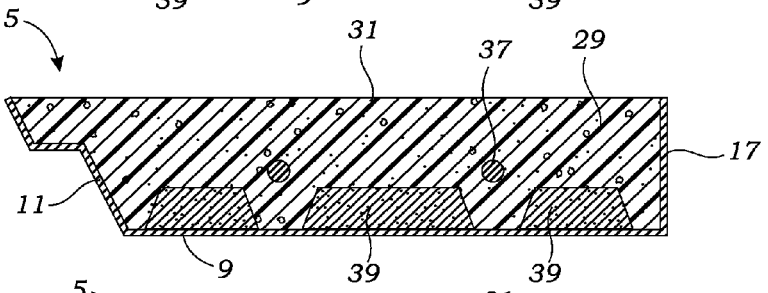
FIG. 5D is a side cross-sectional view of a fourth embodiment of the stair tread from FIG. 4.
Figure 5E:
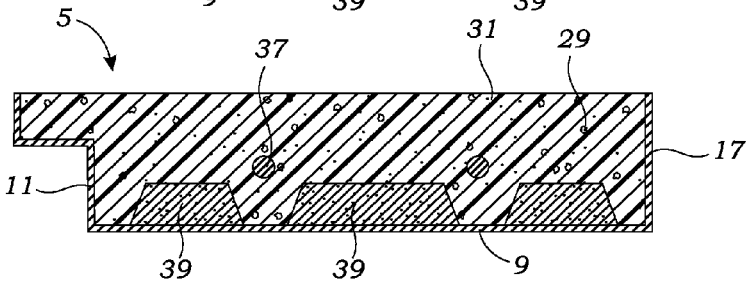
FIG. 5E is a side cross-sectional view of a fifth embodiment of the stair tread from FIG. 4.

In certain embodiments, the stair tread 5 includes one or more reinforcing members 37. The one or more reinforcing members 37 can be arranged to extend laterally, longitudinally, or any other direction relative to the pan 7 so as to provide added stiffness to the stair tread 5. Preferably, the one or more reinforcing members 37 are traditional metal bars such as traditional rebar. With reference to FIGS. 1 and 5, in certain embodiments, the stair tread 5 includes one or more integral foam blocks 39. Preferably, the foam blocks 39 are positioned at the bottom of the pan 7 and the metal bars 37 are positioned atop the foam blocks 39 prior to the concrete being formed. Advantageously, the foam blocks 39 lighten the stair tread 5 making them easier to transport and install. In addition, the foam blocks 39 introduce some resilience to the stair tread 5 so as to make the tread less prone to cracking.

Figure 8A:
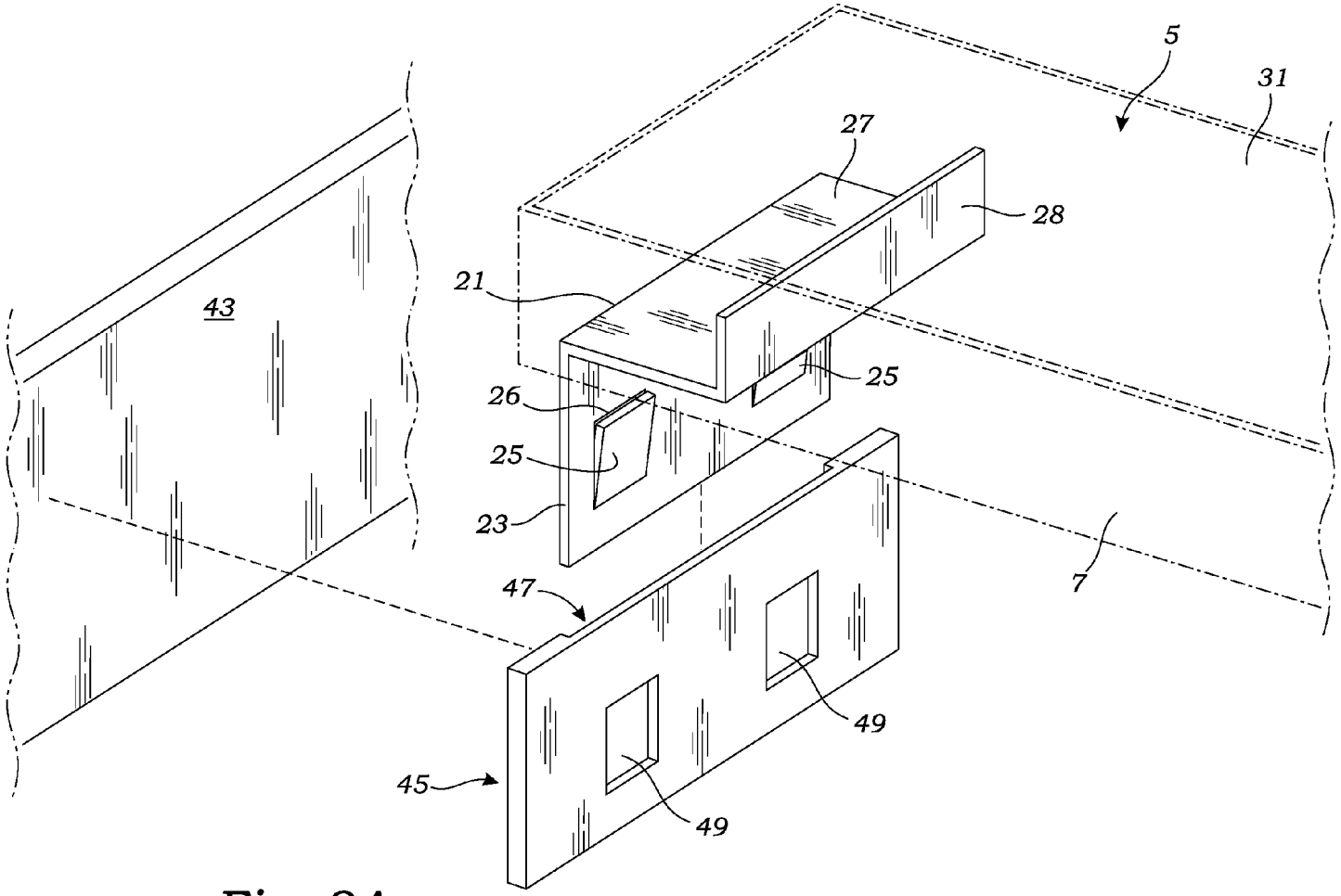
FIG. 8A is an exploded view illustrating the alignment of a side of the stair tread from FIG. 4 with a stringer.
Figure 8B:
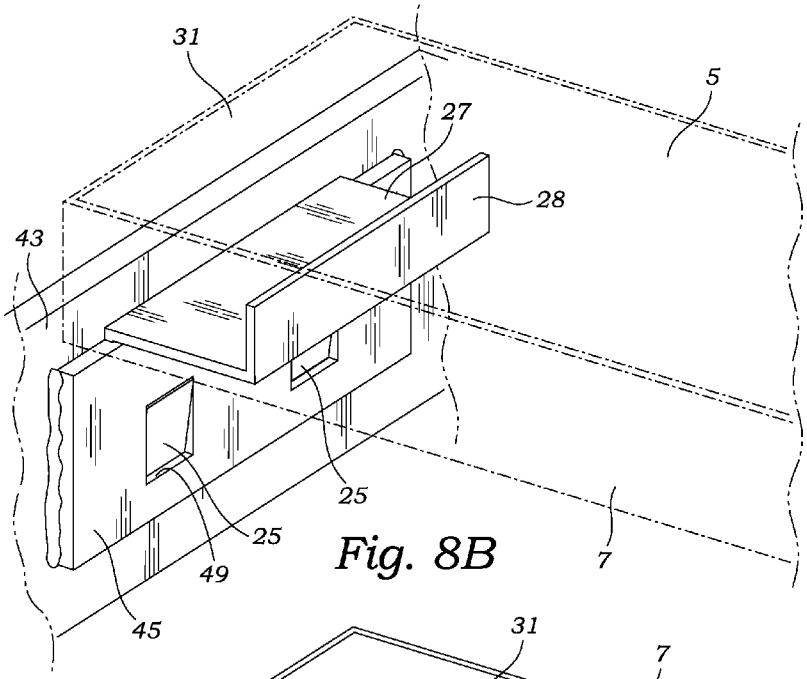
FIG. 8B is a perspective view illustrating the stair tread in phantom lines affixed to the stringer utilizing a preferred bracket assembly.
Figure 8C:
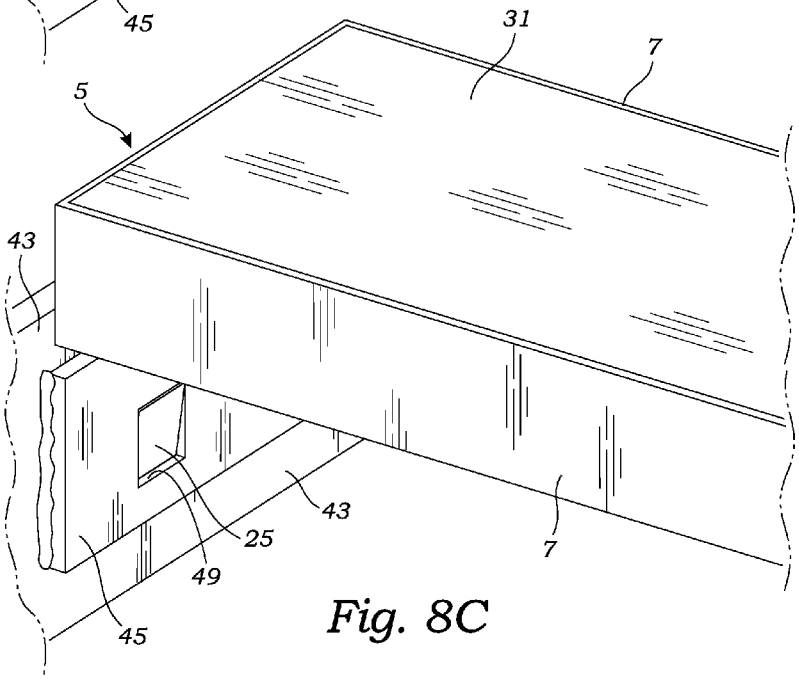
FIG. 8C is similar to FIG. 8B except the stair tread is illustrated in solid lines.

Once the concrete 29 has hardened, the stair tread 5 is transported from its manufacturing site 53 to a job site 59 for producing a stairway assembly 1. As illustrated in FIGS. 8-10, the stair tread 5 can be affixed to a stringer 43 utilizing various fasteners as can be determined by those skilled in the art. However, in certain embodiments, the fastener is a bracket assembly that does not require any tools to affix the stair tread 5 to the stringers 43. The bracket assembly includes a pan bracket 21 and a stringer bracket 45. As illustrated in the figures, the pan bracket 21 is affixed to each of the pan's sidewalls 13, 15. The bracket 21 includes a flange 23 which projects vertically downward from the bottom of each side of the pan 7. In addition, each flange 23 can include one or more flexible tabs 25 which project slightly horizontally from the flange's vertically extending member. Each flexible tab 25 is capable of biasing into an opening 26 formed in the flange 23. In certain embodiments, the pan brackets 21 are made of metal, for example, steel. In certain embodiments, the pan bracket 21 is made from 20 gauge steel of the same type as utilized to manufacture the pan 7. As illustrated in FIGS. 8A and 8B, the pan bracket 21 may include a horizontal component 27 and a vertical component 28. The horizontal component 27 can be welded to the pan's bottom wall 9 and the bracket's vertical component 28 can project upwardly through the pan 7 into the concrete 29 to provide additional strength and stiffness.

Meanwhile, the bracket assembly further includes one or more stringer brackets 45 configured to be affixed to the stringers 43. In certain embodiments, the stringer brackets 45 are made of 20 gauge steel. In embodiments where the stringers 43 are made of metal, the stringer brackets 45 can be made from metal to allow the stringer brackets 45 to be welded to the interior sides of the stringer 43 (see FIGS. 8-10). In certain embodiments, the stringer brackets 45 include a vertically extending slot 47 with an opening at the top of the bracket 45 for receipt of the pan bracket's flange 23 so as to allow the flange 23 to project downwardly into the stringer bracket's slot 47. Openings 49 disposed in the stringer bracket 45 can be configured to receive the pan bracket's tabs 25 for locking the stringer bracket 45 to the pan bracket 21, which in turn locks the stair tread 5 to the stringer 43. Advantageously, a plurality of treads 5 can be dropped and locked in place between two stringers 43 to form a stairway assembly 1 without the requirement of any tools.

With reference to FIGS. 6, 7 and 11, the method of manufacturing a stairway 1 includes manufacturing the stair treads 5 through mass production facilities at a manufacturing site. To this end, in certain embodiments, traditional 20 gauge sheet metal is stamped, formed or otherwise bent to produce the pan 7. The foam blocks 39 and the metal bars 37 are placed in the pan's cavity 19, and wet concrete 29 is poured into the cavity 19 and allowed to harden. As illustrated in FIG. 6, in certain embodiments, the concrete is poured and allowed to harden through a conveyor belt system 55. The pan brackets 21 are affixed to the pan 7, preferably through a welding process, and the completed stair treads 5 are stacked, such as on pallets, for transportation to the job site 59 for constructing the stairway assembly 1. As illustrated in FIGS. 8-10, each stair tread 5 can be affixed to the parallel stringers 43 in a matter of minutes so as to rapidly produce the stairway assembly 1.

While several particular embodiments have been illustrated and described, it will be apparent that various modifications can be made without departing from the spirit and scope of the present disclosure. In addition, while a number of variations of the present disclosure have been shown and described in detail, other modifications, which are within the scope of this disclosure, will be readily apparent to those of skill in the art based upon this disclosure. It is also contemplated that various combinations or sub-combinations of the specific features and aspects of the embodiments may be made and still fall within the scope of the disclosure. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the disclosure and the claims that follow.

What is claimed is:

1. A method of installing a stair tread comprising the steps of:

providing, offsite of installation, a metal pan including a bottom, first and second sidewalls, a front wall, and a rear wall forming a cavity;

positioning one or more foam inserts into the metal pan's cavity;

pouring concrete filler into said metal pan after said foam insert has been positioned into said pan, and allowing said concrete filler to harden to create, offsite of installation, a stair tread having an upper walking surface;

providing, at an installation site, a first stringer and a second stringer forming a pair of parallel stringers, the pair of parallel stringers being configured for supporting the stair tread to form at least a portion of a stairway;

transporting said stair tread from the offsite to the installation site; and affixing said metal pan to said first stringer and to said second stringer to form said at least a portion of the stairway.

2. The method of installing a stair tread of claim 1, further comprising:

providing a planar sheet of metal; and forming the planar sheet of metal into the metal pan.

3. The method of installing a stair tread of claim 1, wherein:

the stair tread includes a pair of pan brackets, wherein each pan bracket is affixed adjacent to a sidewall of the metal pan and each of said pan brackets includes a flange that projects vertically downward from a bottom wall of said metal pan; and each of the first stringer and the second stringer includes a stringer bracket, wherein each stringer bracket is affixed to a respective one of the first and second stringers and each stringer bracket includes a vertically extending slot for receiving the flange of the respective pan bracket.

4. The method of installing a stair tread of claim 3, wherein:

each pan bracket includes a flange and a flexible tab which projects from said flange; and each stringer bracket includes an opening sized to receive the flexible tab.

* * * * *